US005666588A

United States Patent [19]

Uchiyama et al.

[11] Patent Number: 5,666,588

[45] Date of Patent: Sep. 9, 1997

[54] IMAGE FORMING APPARATUS FOR PERFORMING IMAGE DENSITY CONTROL

[75] Inventors: Akihiko Uchiyama; Haruo Fujii; Hiroshi Sasame, all of Yokohama; Tatsuya Kobayashi, Soka; Tetsuya Kobayashi, Kawasaki; Naoki Enomoto; Yoshiro Saito, both of Yokohama; Yoichiro Maebashi, Kawasaki; Takaaki Tsuruya, Yokohama, all of Japan

[73] Assignee: Canon Kabushiki Kaisha, Tokyo, Japan

[21] Appl. No.: 629,750

[22] Filed: Apr. 9, 1996

[30] Foreign Application Priority Data

Apr. 11, 1995 [JP] Japan ..... 7-085358

[51] Int. Cl.[6] ..... G03G 15/00

[52] U.S. Cl. ..... 399/44; 399/49; 399/55

[58] Field of Search ..... 399/44, 49, 55, 399/39, 72

[56] References Cited

U.S. PATENT DOCUMENTS

| | | | |
|---|---|---|---|
| 4,789,878 | 12/1988 | Endo et al. | 355/14 D |
| 4,814,834 | 3/1989 | Endo et al. | 355/14 D |
| 5,103,260 | 4/1992 | Tompkins et al. | 399/39 |
| 5,175,585 | 12/1992 | Matsubayashi et al. | 399/49 |
| 5,351,107 | 9/1994 | Nakane et al. | 399/49 |

*Primary Examiner*—Joan H. Pendegrass

*Attorney, Agent, or Firm*—Fitzpatrick, Cella, Harper & Scinto

[57] ABSTRACT

By altering a developing bias, a plurality of patch images are formed on a photoconductor, and a density of each patch image is measured, thereby judging whether or not a target density value is within a range of the plurality of measured density values. If the target density value is outside the range, a developing bias which realizes the target density is obtained by an interpolation, in accordance with two measured density values that are closest to the target density value among a plurality of measured densities, and with a developing bias of two patch images that are related to these two measured density values.

29 Claims, 13 Drawing Sheets

IMAGE FORMING APPARATUS FOR PERFORMING IMAGE DENSITY CONTROL

BACKGROUND OF THE INVENTION

The present invention relates to an image forming apparatus which performs image density control.

Generally, in an image forming apparatus utilizing an electro-photographic printing method, an image density largely varies depending on various conditions such as an environmental change of where the apparatus is placed or the number of pages to be printed. Therefore, conventionally a toner image for density detection (hereinafter referred to as a patch) with a maximum density (Dmax) is formed on a photosensitive drum or the like and the density is detected by an optical sensor. Then, the detected result is fed back to image forming conditions such as a developing bias, to perform maximum density control (Dmax control) which utilizes a Dmax value as a predetermined value. By this method, an image having a stable density can be obtained.

The Dmax control will be described below.

An image density control circuit which constitutes an image forming apparatus activates a pattern generation circuit to generate an image signal, which is indicative of a density detection patch. By following the signal, latent images of four patches P1 to P4 are formed along a driving direction of a photosensitive drum. These latent images are then developed by a developing device. Herein, a developing bias potential (V DC) is changed for every patch by a high-voltage control circuit, e.g. V1 for the first patch P1, V2 for P2, V3 for P3, and V4 for P4; accordingly, each patch is developed in different developing bias. Density values D1 to D4 for each of the formed patches P1 to P4 on the photosensitive drum are measured by a density sensor.

When a latent image of a density detection patch is developed in different developing bias V DC, the relationship (V-D characteristic) between a developing bias (V DC) and a density (O.D.) of a patch at a normal temperature and normal humidity can be illustrated as shown in FIG. 9. As apparent from FIG. 9, the V-D characteristic consists of portions A and C, where the characteristic shows a little variance, and a portion B where the characteristic shows a considerable variance. The V-D characteristic also changes, for instance as shown in FIG. 10, depending on an environment where an image forming apparatus is placed. In the chart of FIG. 10, the characteristic curve indicated as a is identical to that of FIG. 9; b is a characteristic curve under a high-temperature and high-humidity environment; and c is a characteristic curve under a low-temperature and low-humidity environment.

As shown in the V-D characteristic illustrated in FIG. 9, variance of the density in the portions A and C is unstable, but the density in the portion B shows a stable increase. Therefore, for the Dmax control, a control target DTarget is set at the portion B as shown in FIG. 10. Relationships among density values D1 to D4 for each patch is D1<D2<D3<D4 and the developing biases V1 to V4 are set so that DTarget comes virtually to a mid-portion of D1 and D4. Values V1 to V4 are so selected that the DTarget is within a range of D1 to D4 even if the values D1 to D4 change due to a minor variance of the V-D characteristic. Also, for the purpose of simplifying a forthcoming calculation, the values V1 to V4 are set so that the difference between V4 and V3, V3 and V2, V2 and V1 (indicated as w in FIG. 10, and approximately 50 V) are all equal.

Since the V-D characteristic can vary largely depending on an environment as described above, there is a case where the DTarget exceeds the range of D1 to D4 when the values V1 to V4 are fixed (see b and c in FIG. 10). To cope with this situation, the developing biases V1 to V4 are set to vary depending upon an environment such as high temperature and high humidity or low temperature and low humidity as shown in FIGS. 11 and 12 respectively, so that the DTarget comes virtually to the mid-portion of D1 and D4.

For the above described developing biases V1 to V4, when a Dmax control is initiated, appropriate values for the Dmax control in an environment at the time the control is initiated are selected based on absolute moisture quantity of an image forming apparatus obtained from a temperature-humidity sensor embodied in the apparatus. Then, the most appropriate developing bias VTarget is computed in an image density control circuit to realize a density with respect to the control target DTarget, by utilizing data for the density values D1 to D4 of each patch measured by the density sensor and the developing biases V1 to V4 at the time when the patch is formed.

A method of computing the most appropriate developing bias begins with seeking a section, within D1 to D4, which includes DTarget, i.e. a section which satisfies $Di \leqq D \leqq Di+1$ (i is either 1, 2 or 3). When such section is found, a developing bias VTarget for obtaining a DTarget is computed by a linear interpolation. For instance, as shown in FIG. 13, when a density DTarget, which is a control target, is positioned in-between D2 and D3, the most appropriate developing bias VTarget is computed by the following equation.

$$\text{VTarget}=\{(V3-V2)/(D3-D2)\}\times(\text{DTarget}-D2)+V2 \quad (1)$$

Then, the computed developing bias VTarget is stored in a memory and utilized for forming an image until next Dmax control is performed.

However, in the above described image forming apparatus, the density DTarget must be within the range of D1 to D4 in order to compute the developing bias VTarget. When the DTarget exceeds that range, an error processing such as selection of a predetermined developing bias as a default is performed.

Herein, the developing bias as a default is an intermediate value between V1 and V4, or V1 if DTarget<D1 holds, or V4 if D4<DTarget holds.

Although an image of minimum quality is ensured in this case, it is impossible to obtain an image having a stable density. In order to perform accurate image density control, it is necessary to set an appropriate developing bias by altering the developing biases V1 to V4 according to an environment where an image forming apparatus is placed, as explained above. However, even if an appropriate developing bias is set, there is a problem that a DTarget exceeds the range of D1 and D4 due to a decrease in durability of toner, an acute change of an environment which cannot be followed by the temperature-humidity sensor, or deterioration of the photosensitive drum.

Accordingly, in order to prevent such problem from occurring, a method can be thought of: such as widening a range w for each of the developing biases V1 to V4, or increasing the number of patches to more than five so that the range of a developing bias which can be controlled by the Dmax control is extended. However, the method of widening the range of the developing bias increases errors caused by a linear interpolation and the method of increasing the number of patches increases consumption of toner.

SUMMARY OF THE INVENTION

The present invention has been made in consideration of the above situation, and has as its object to provide an image forming apparatus and a density control method where foregoing drawbacks have been overcome.

Another object of the present invention is to provide an image forming apparatus and a density control method which enables to obtain an image having a stable density despite an environmental change.

Another object of the present invention is to provide an image forming apparatus and a density control method which enables to obtain an image having a stable density by performing an accurate image-density control at all times without unnecessarily consuming toner.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiment of the invention and, together with the description, serve to explain the principles of the invention.

DETAILED DESCRIPTION OF THE PREFERRED EMBODIMENTS

Preferred embodiments of the present invention will be described in detail in accordance with the accompanying drawings.

<First Embodiment>

Figure 1:
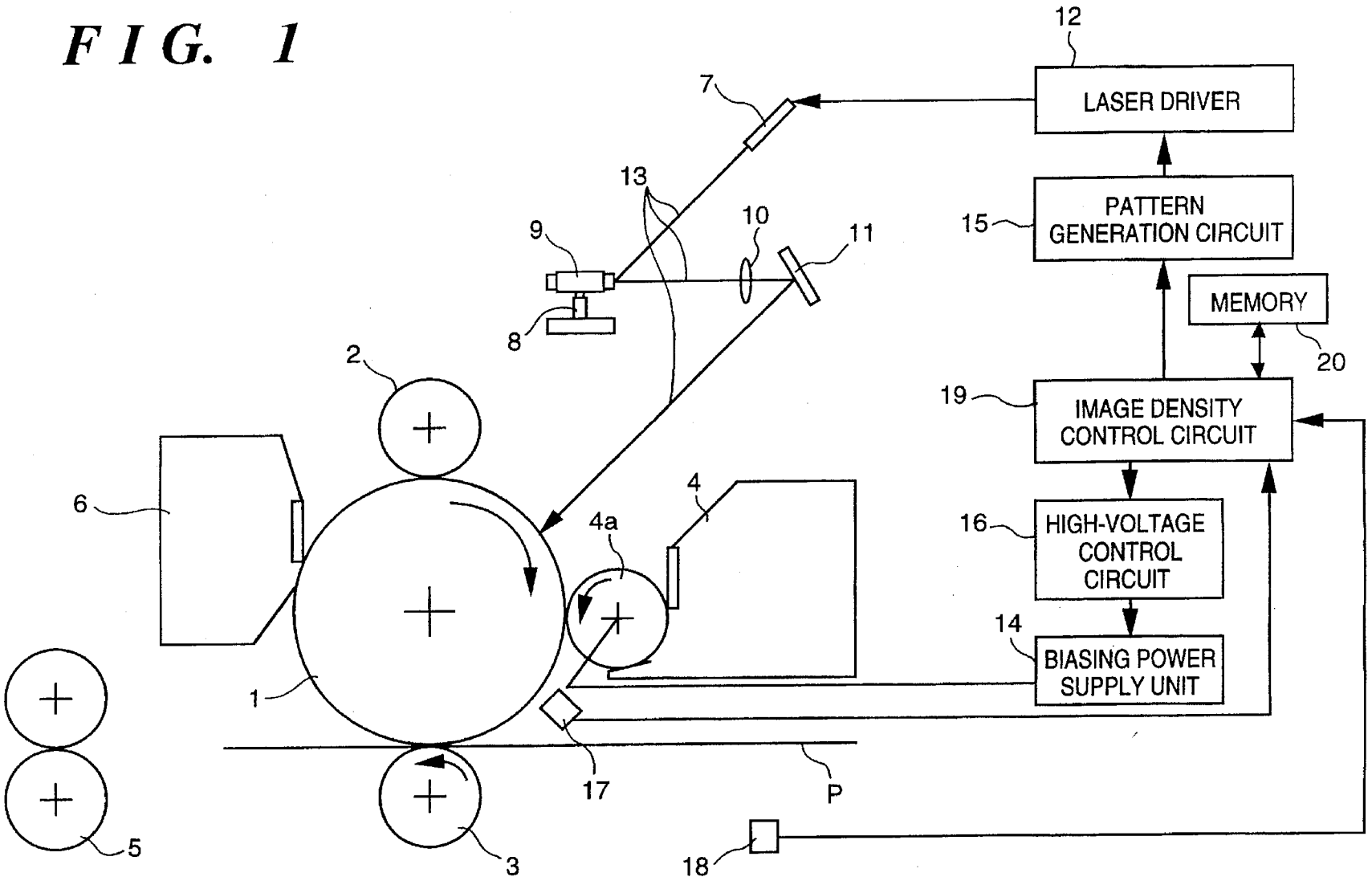
FIG. 1 is a cross-sectional view showing the construction of an image forming apparatus according to embodiments of the present invention.

FIG. 1 is a vertical cross-sectional view of an image forming apparatus according to the first embodiment of the present invention. In FIG. 1, a photosensitive drum 1 is structured by having an external surface of an aluminum cylinder being coated with an organic photoconductor (OPC) or an optical conductor consisting of A-Si, CdS, Se and so on. The photosensitive drum is driven in a direction indicated with an arrow in FIG. 1 by driving means (not shown) and uniformly charged to a predetermined potential by a roller charger 2.

In the upper section of the image forming apparatus, following components which constitute an exposure apparatus are placed: a laser diode 7, a polygonal mirror 9 rotated by a high-speed motor 8, a lens 10 and a mirror 11.

When an image signal is inputted in a laser driver 12, the laser diode irradiates light which is modulated by the image signal from the laser driver 12. A latent image is formed on the photosensitive drum 1 by the light being irradiated on the photosensitive drum 1 via a light path 13.

When the photosensitive drum 1 rotates in a direction indicated with the arrow, a developing bias, in which a DC voltage and an AC voltage having a frequency of 800 to 3500 Hz, an amplitude of 400 to 3000 V, and an integral mean value of a waveform V DC of −50 to −550 V superimposed thereon, is applied between the photosensitive drum 1 and a developing sleeve 4*a* in a developing apparatus 4 by a biasing power supply unit 14. As a result, the latent image is developed and becomes a toner image. The toner image developed in the above-described manner is transferred to a transfer sheet P by a transfer roller 3 in which a predetermined bias has been impressed thereon. Then, the transfer sheet P to which the toner image is transferred is carried by carrying means (not shown), and the toner image is dissolved and fixed by a fixing apparatus 5 to create a permanent image.

Note that remaining toner on the photosensitive drum 1 is cleaned by a cleaning device 6 consisting of a fur brush, blade means or the like.

Further, a reference numeral 19 denotes an aforementioned image density control circuit; 15, an aforementioned pattern generation circuit; and 16, an aforementioned high-voltage control circuit. A reference numeral 17 denotes a density sensor which detects a density of a patch formed on the photoconductor; and 18, a temperature-humidity sensor which detects an temperature and a humidity inside of the image forming apparatus. An output of each of the sensors is inputted in the image density control circuit 19 to be utilized for a density control as described above. A developing bias potential used for the Dmax control, a control target density DTarget and a most appropriate developing bias computed by the image density control circuit 19 are stored in a memory 20.

Hereinafter, the Dmax control performed by the image forming apparatus according to the present invention will be described.

Figure 2:
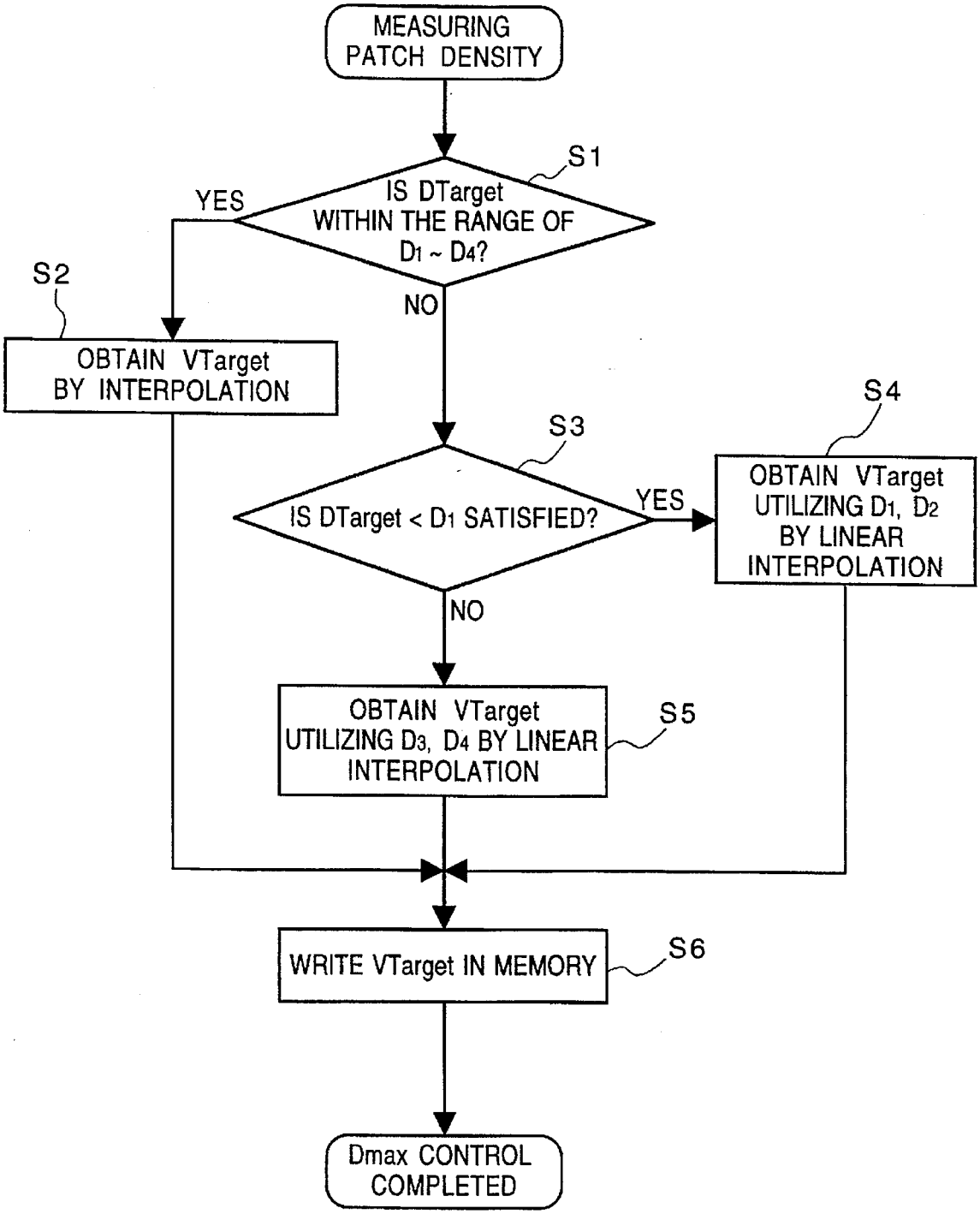
FIG. 2 is a flowchart showing a process after a density of a patch is measured in the first embodiment.

FIG. 2 is a flowchart illustrating a process after density measurement of a patch with respect to the Dmax control according to the present embodiment.

First, absolute moisture quantity is detected by the temperature-humidity sensor 18 to determine a developing bias for developing patches as well as a control target density DTarget, and four patches P1 to P4 are formed. Then, densities D1 to D4 for the patches P1 to P4 are detected by the density sensor 17. When the densities D1 to D4 for the patches P1 to P4 are obtained, a section which includes a control target DTarget is searched within the range from D1 to D4 (step S1 in FIG. 2). If the section is found, a developing bias VTarget is computed by the linear interpolation similar to the one described above (step S2).

Figure 3:
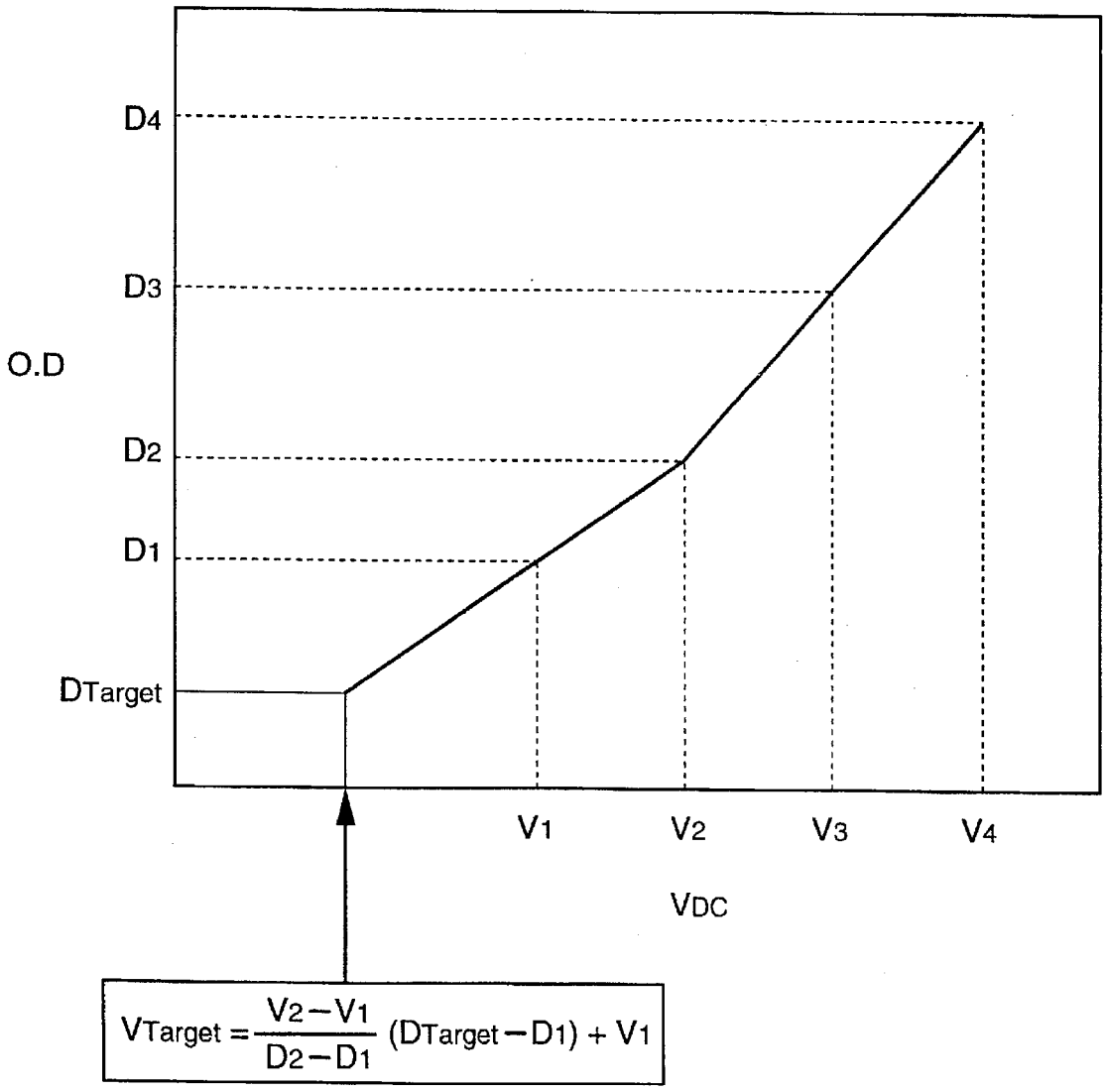
FIG. 3 is a chart showing an interpolation method utilized in the case where a control target density exceeds a range of a patch density obtained by an image density control in the first embodiment.

If the control target DTarget is not included in the range from D1 to D4 (determination of the step S1 is NO), and for instance, if DTarget<D1 as shown in FIG. 3 (determination of the step S3 is YES) holds, a developing bias VTarget is computed by linear extrapolation utilizing the two measured points D1 and D2 (step S4). In other words, the developing bias VTarget is computed by the following equation:

$$VTarget=\{(V2-V1)/(D2-D1)\}(DTarget-D1)+V1 \quad (2)$$

Figure 4:
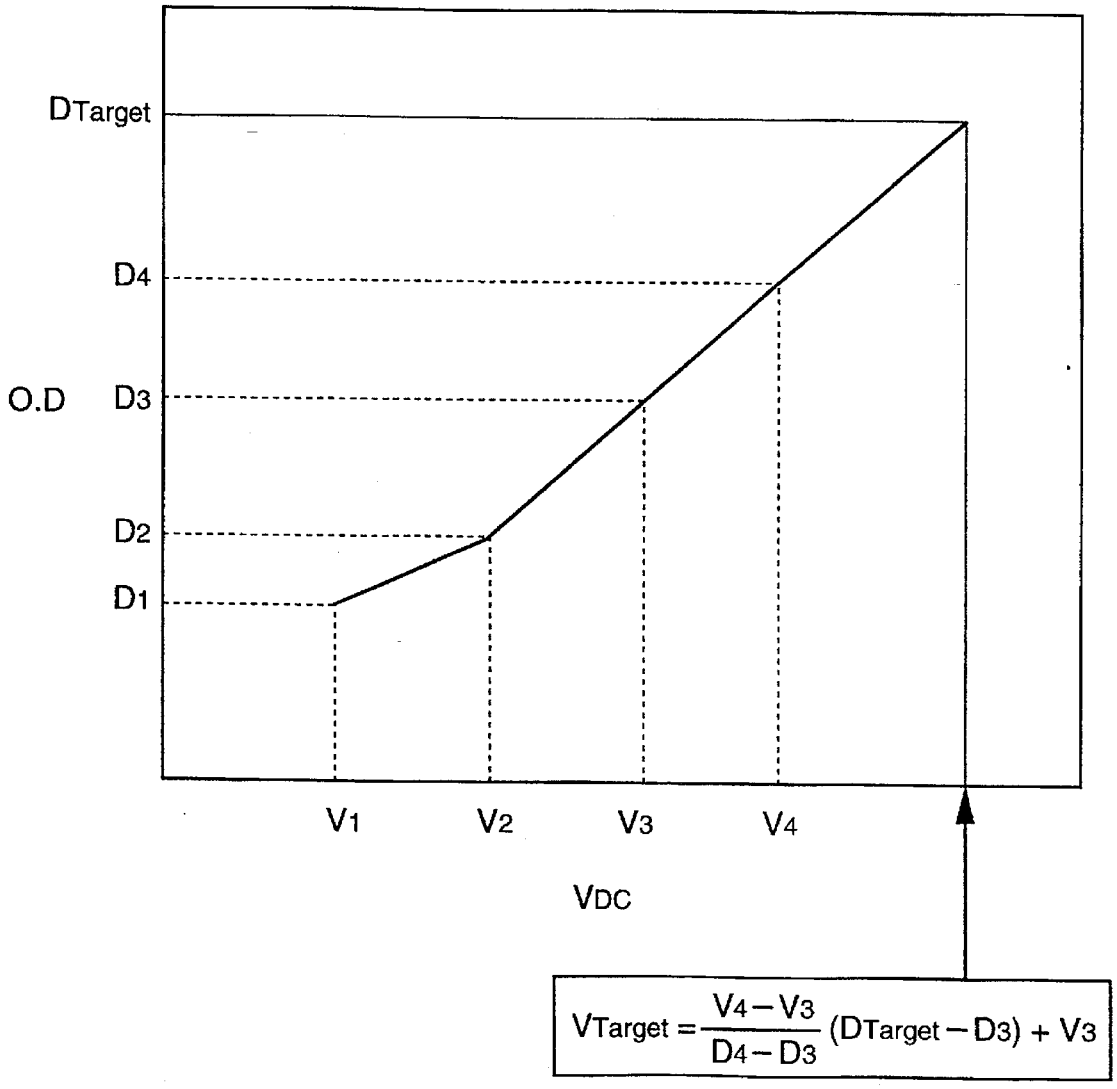
FIG. 4 is a chart showing an interpolation method utilized in the case where a control target density exceeds a range of a patch density obtained by an image density control in the first embodiment.

If the control target DTarget is not included within the range from D1 to D4, and if D4<DTarget as shown in FIG. 4, a developing bias VTarget is computed by a linear extrapolation utilizing the two measured points D3 and D4 (step S5). In other words, a developing bias VTarget is computed by the following equation:

$$VTarget=\{(V4-V3)/(D4-D3)\}(DTarget-D3)+V3 \quad (3)$$

The developing bias VTarget computed in the above manner is stored in the memory 20 (step S6) and utilized for an image forming until the next Dmax control is performed.

As has been discussed above, according to the present embodiment, even when the control target DTarget is not included in the range of patch density values D1 to D4 due to a variance of the V-D characteristic caused by an environmental change, it is possible to perform the Dmax control at all times without causing an error, by performing a linear extrapolation utilizing values corresponding to two points in D1 to D4. As a result, an image having a stable density can be obtained.

<Second Embodiment>

Next, a second embodiment of the present invention will be described below. Note that an image forming apparatus according to the second embodiment is identical in its structure to the image forming apparatus according to the first embodiment; therefore, drawings and a description thereof will be omitted.

Figure 5:
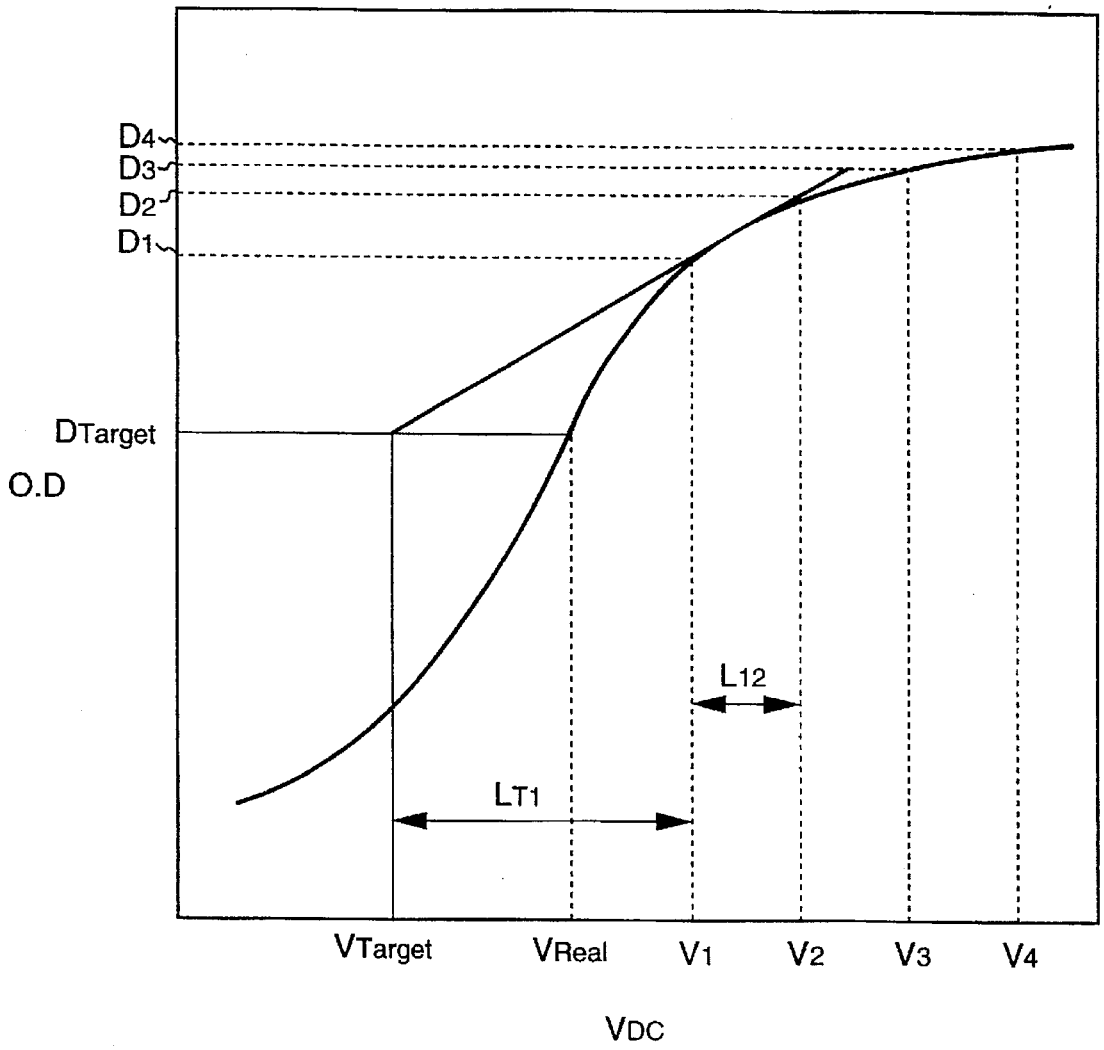
FIG. 5 is a chart illustrating that a developing bias obtained by an extrapolation is different from the tangible most appropriate developing bias, when a V-D characteristic is radically changed.
Figure 6:
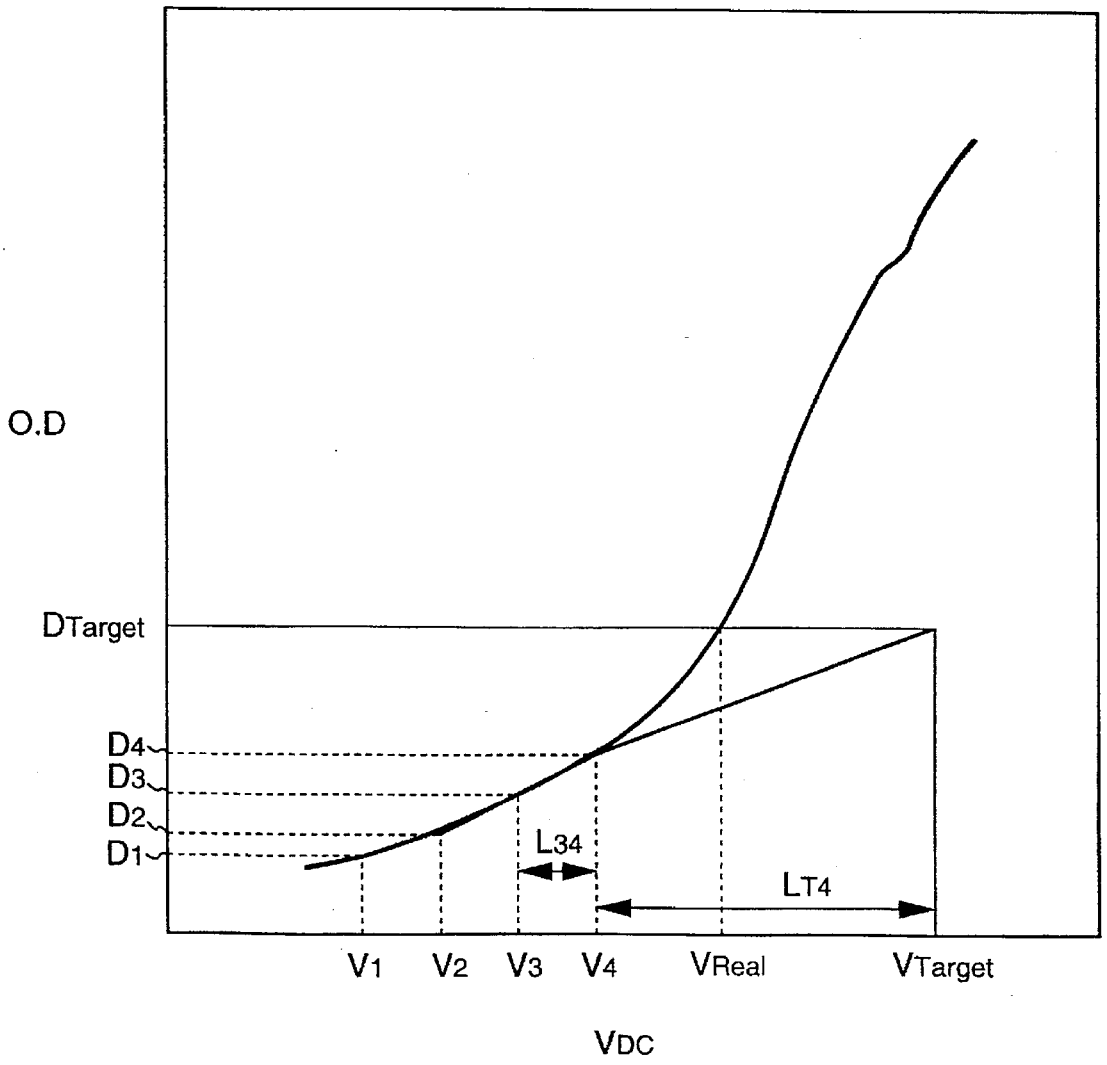
FIG. 6 is a chart illustrating that a developing bias obtained by an extrapolation is different from the tangible most appropriate developing bias, when a V-D characteristic is radically changed.
Figure 9:
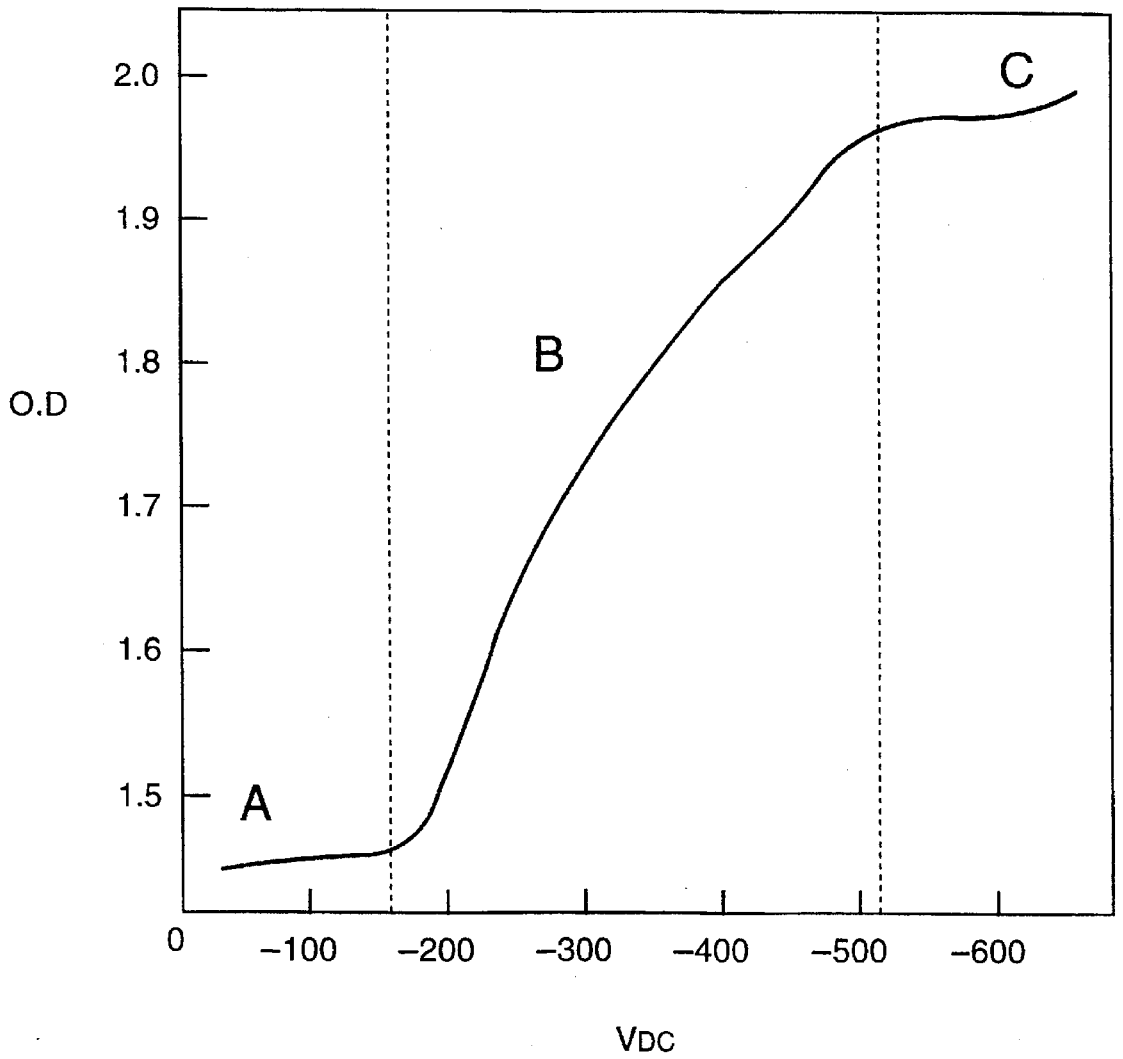
FIG. 9 is a chart illustrating a V-D characteristic which is a relationship between a developing bias and a patch density.
Figure 10:
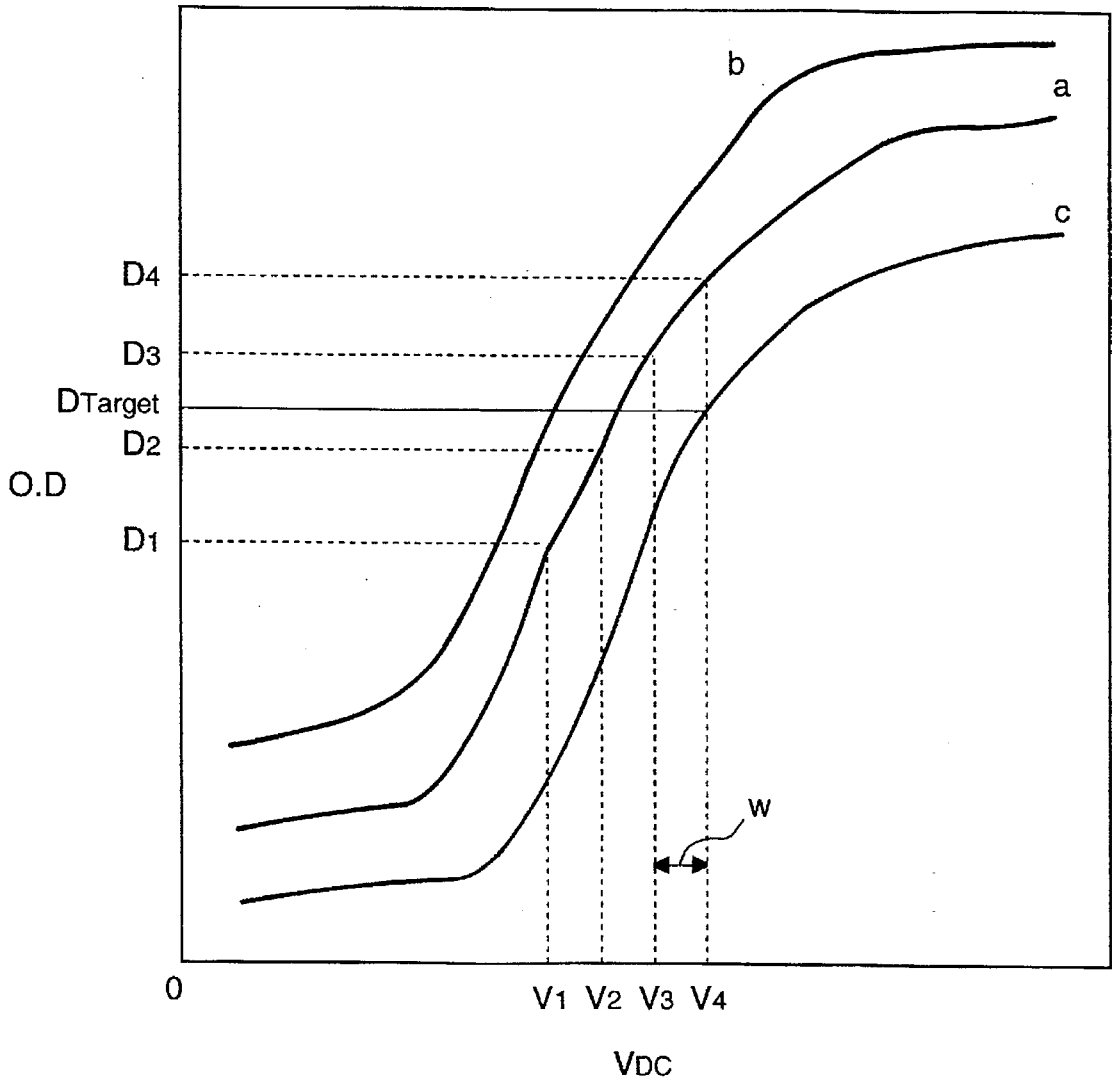
FIG. 10 is a chart illustrating V-D characteristics in different environments and a determination method of a developing bias utilized in an image density control.
Figure 11:
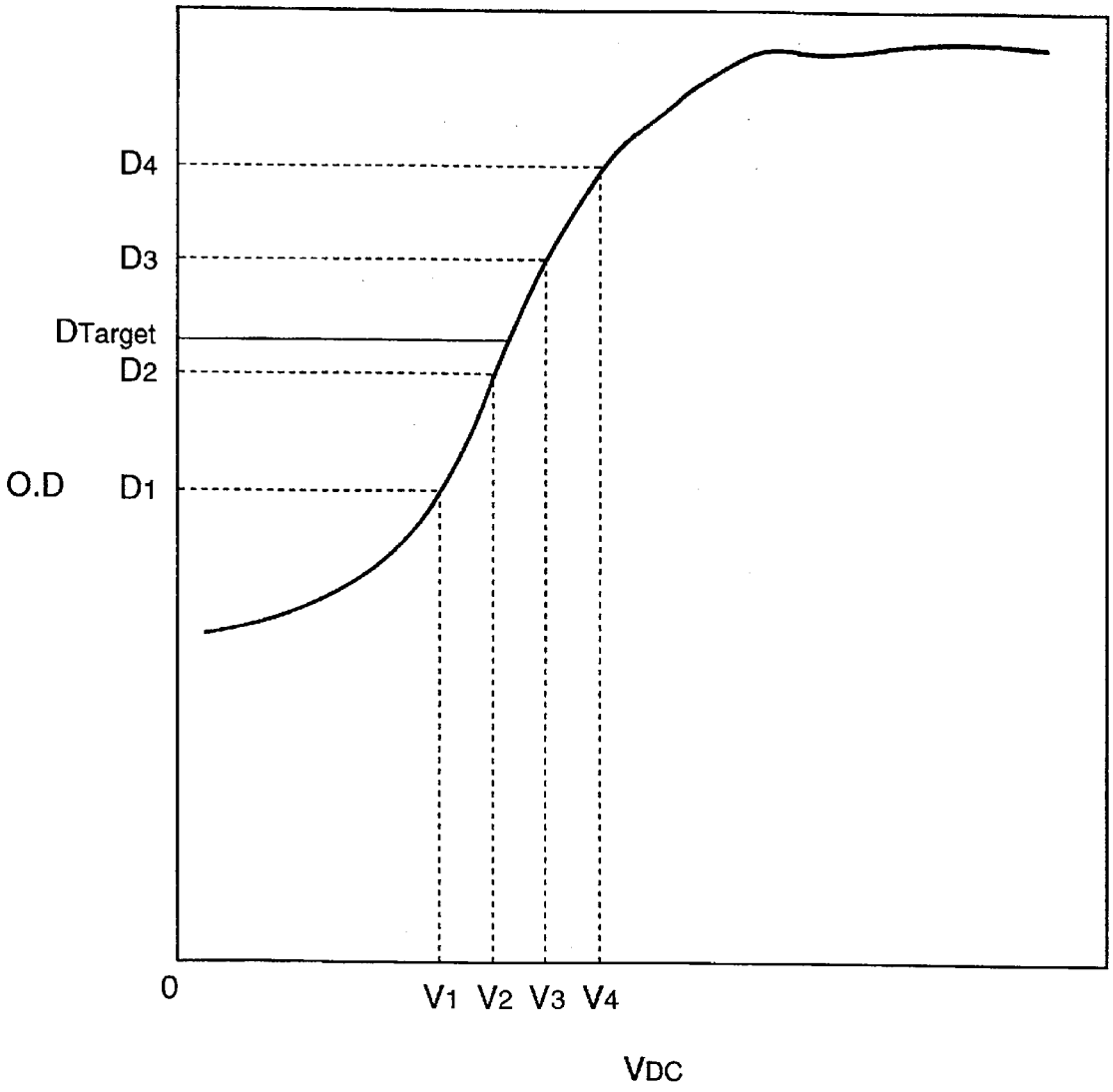
FIG. 11 is a chart showing a determination method of a developing bias utilized in an image density control with a high-temperature and high-humidity environment.
Figure 12:
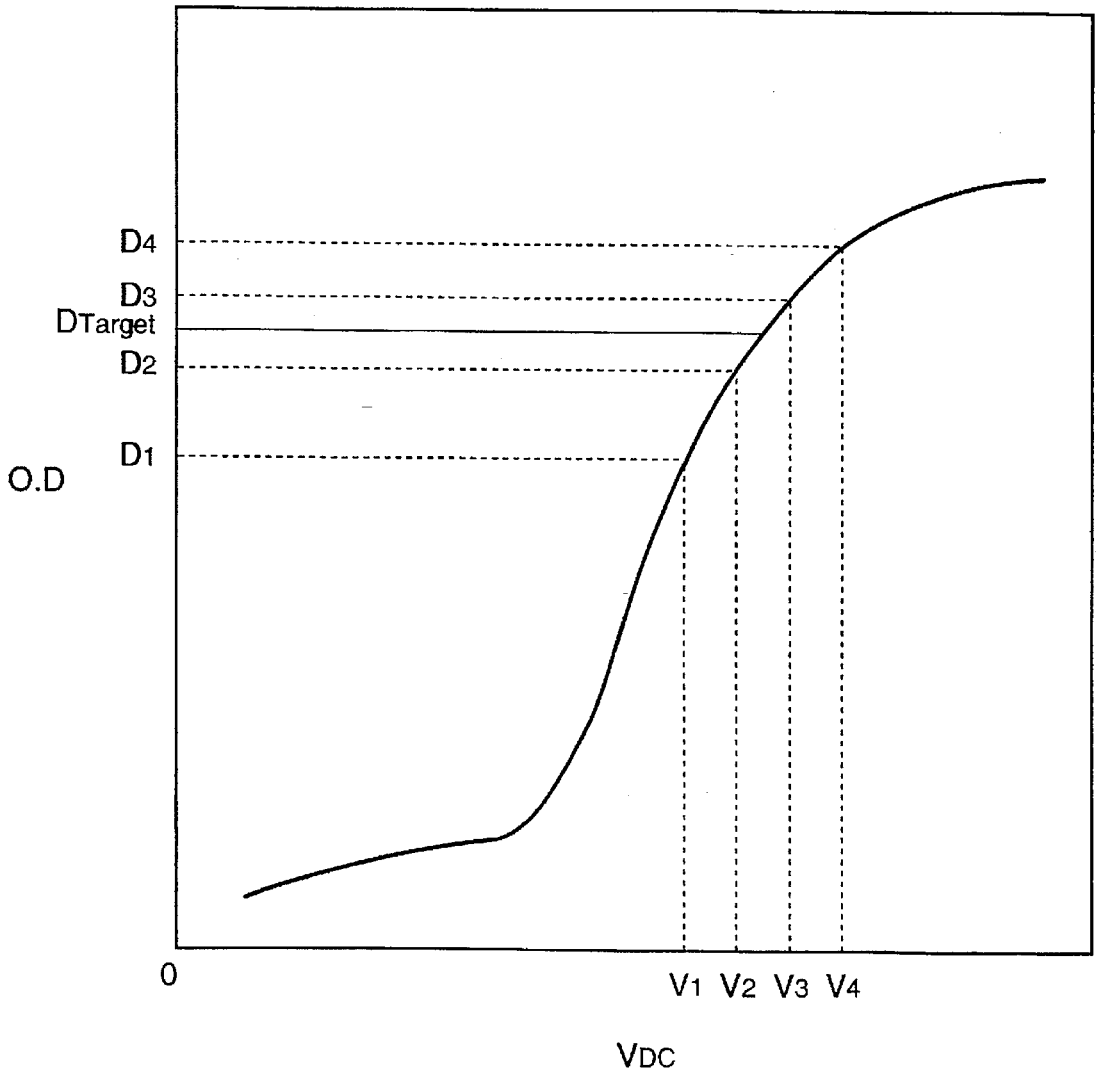
FIG. 12 is a chart showing a determination method of a developing bias utilized in an image density control with a low-temperature and low-humidity environment.
Figure 13:
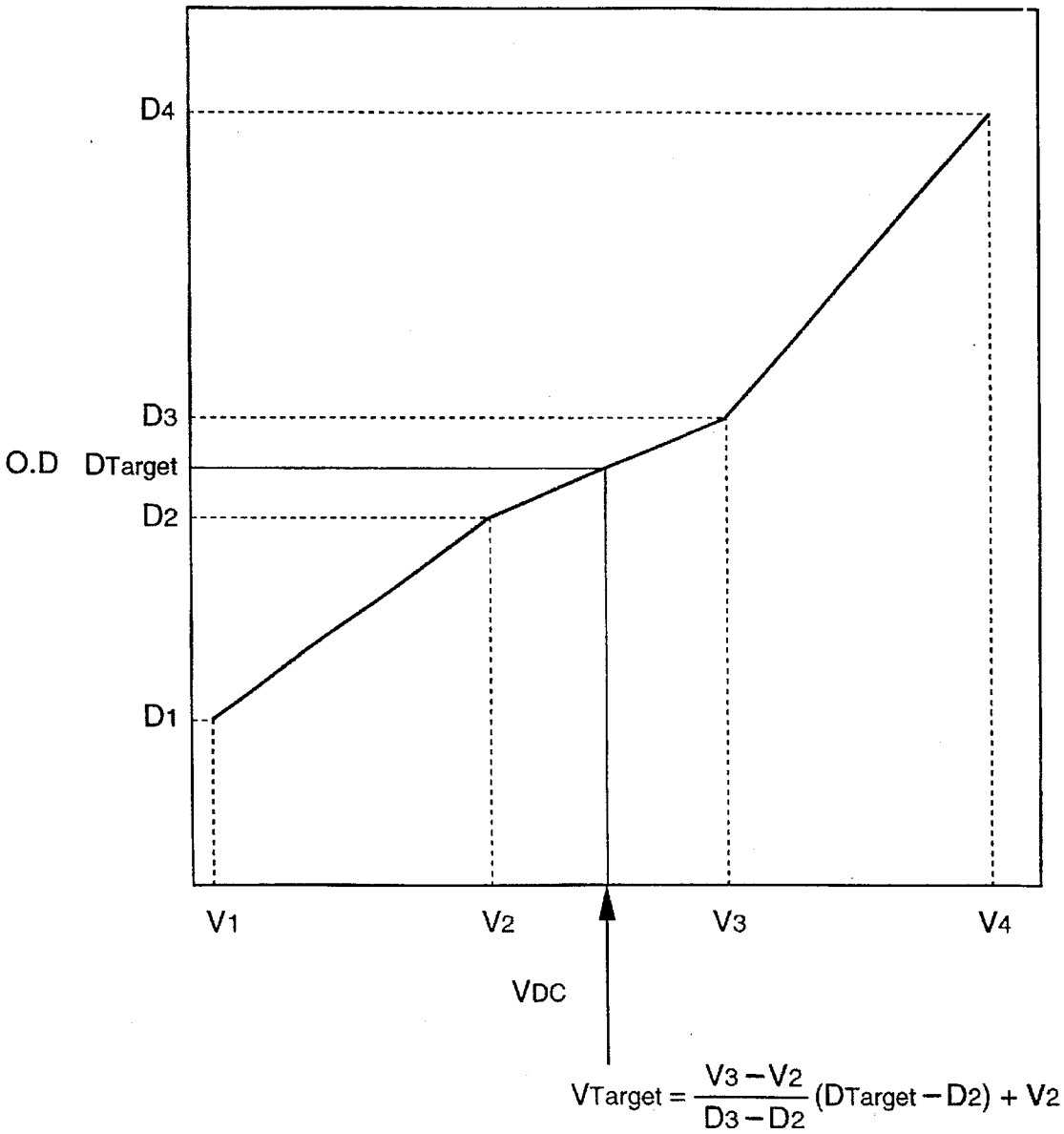
FIG. 13 is a chart showing an interpolation method.

As set forth above, the Dmax control is performed by utilizing B portion of the V-D characteristic shown in FIG. 9. However, when a linear extrapolation is performed, the V-D characteristic is somehow extremely changed from the V-D characteristic determined by the temperature-humidity sensor 18, as shown in FIGS. 5 and 6. Therefore, when the control target density DTarget and the patch density values D1 to D4 are spread out to sections where each section has a different gradient, a developing bias VTarget obtained by the calculation and a most appropriate developing bias VTarget largely differ from each other, resulting an inaccurate control.

Taking the above into consideration, in a case where DTarget<D1, if a ratio LT1/L12, where LT1 is an absolute value of a difference between VTarget obtained by a linear extrapolation and V1, and L12 is an absolute value of a difference between V1 and V2, is more than a predetermined value k, it is determined that DTarget and the values D1 to D4 are spread out to sections in which each section has a different gradient. Alternatively, in a case where D4<DTarget, if a ratio LT4/L34, where LT4 is an absolute value of a difference between VTarget obtained by a linear extrapolation and V4, and L34 is an absolute value of a difference between V3 and V4, is more than the predetermined value k, it is also determined that DTarget and the values D1 to D4 are spread out to sections in which each section has a different gradient. Such cases are regarded as a control error, and a developing bias prepared as a default in the memory 20 in advance will be utilized for later image forming.

On the other hand, if LT1/L12 or LT4/L34 is less than the predetermined value k, a developing bias VTarget obtained by a linear extrapolation is utilized in later image forming, as a result of the Dmax control. Note that a value from 1.5 to 2.5 is preferable for the predetermined value k, however, this value can be altered depending on a V-D characteristic or an accuracy required by the control.

As has been described above, according to the present embodiment, even when the V-D characteristic is somewhat changed, a stable image can be obtained by computing a developing bias utilizing a linear extrapolation. Further, when the V-D characteristic is extremely changed, the default developing bias is utilized to prevent an image quality from becoming even poorer.

<Third Embodiment>

A third embodiment of the present invention will be described below. Note that an image forming apparatus according to the third embodiment is also identical in its structure to the image forming apparatus according to the above-described first embodiment; therefore, drawings and a description thereof will be omitted.

In the foregoing second embodiment, it is determined as a control error in a case where the V-D characteristic is extremely changed and the control target density DTarget and the patch density values D1 to D4 are spread in sections where each section has a different gradient. The present embodiment is characterized in that when LT1/L12 or LT4/L34 is more than the predetermined value k, the Dmax control is performed again by altering the developing biases V1 to V4 which are utilized for forming the patches D1 to D4.

Figure 7:
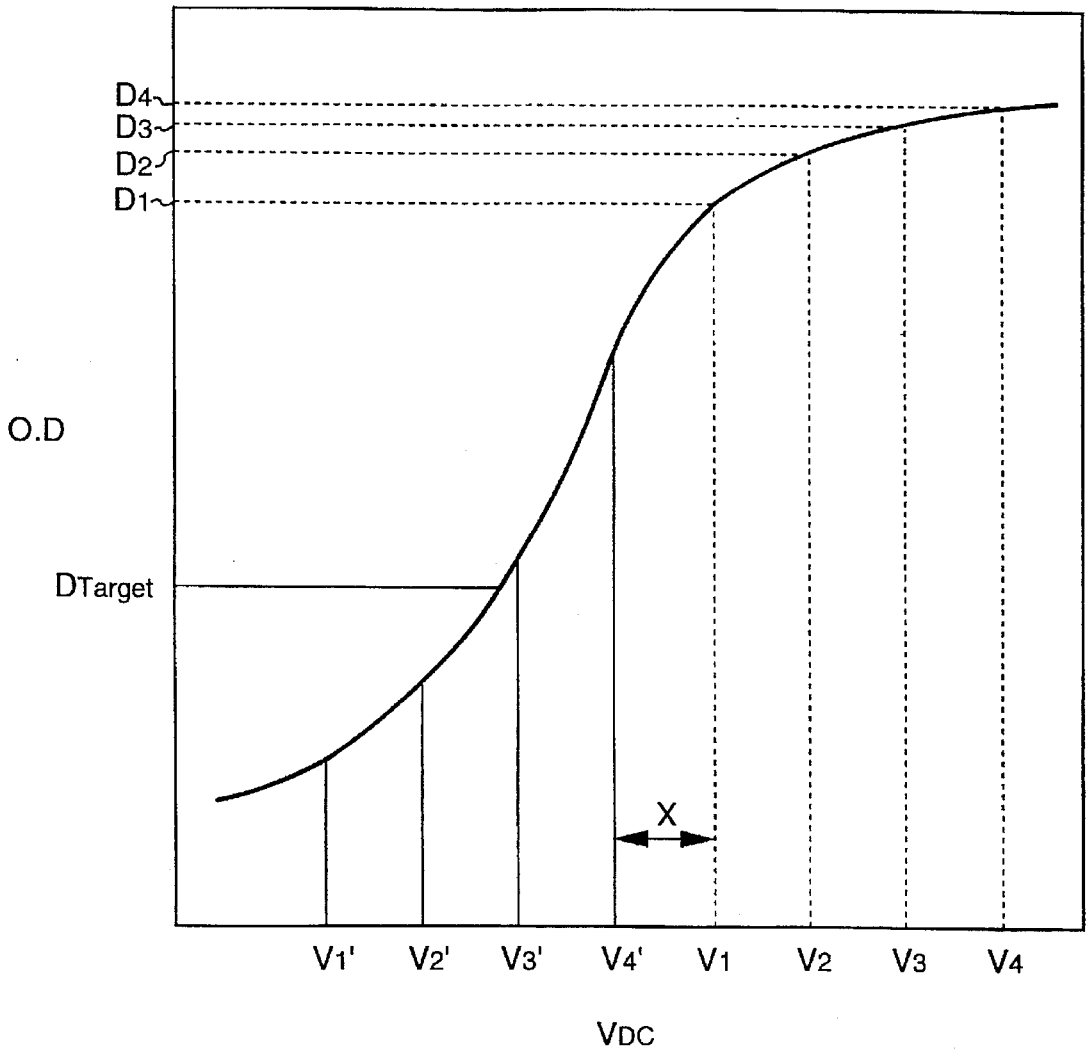
FIG. 7 is a chart showing a developing bias utilized in an image density control according to the third embodiment.

More specifically, when DTarget<D1 and LT1/L12≧k, the characteristic is assumed to be as shown in FIG. 7. Accordingly, developing biases for forming patches are changed to V1', V2', V3' and V4' (<V1) as shown in FIG. 7.

Figure 8:
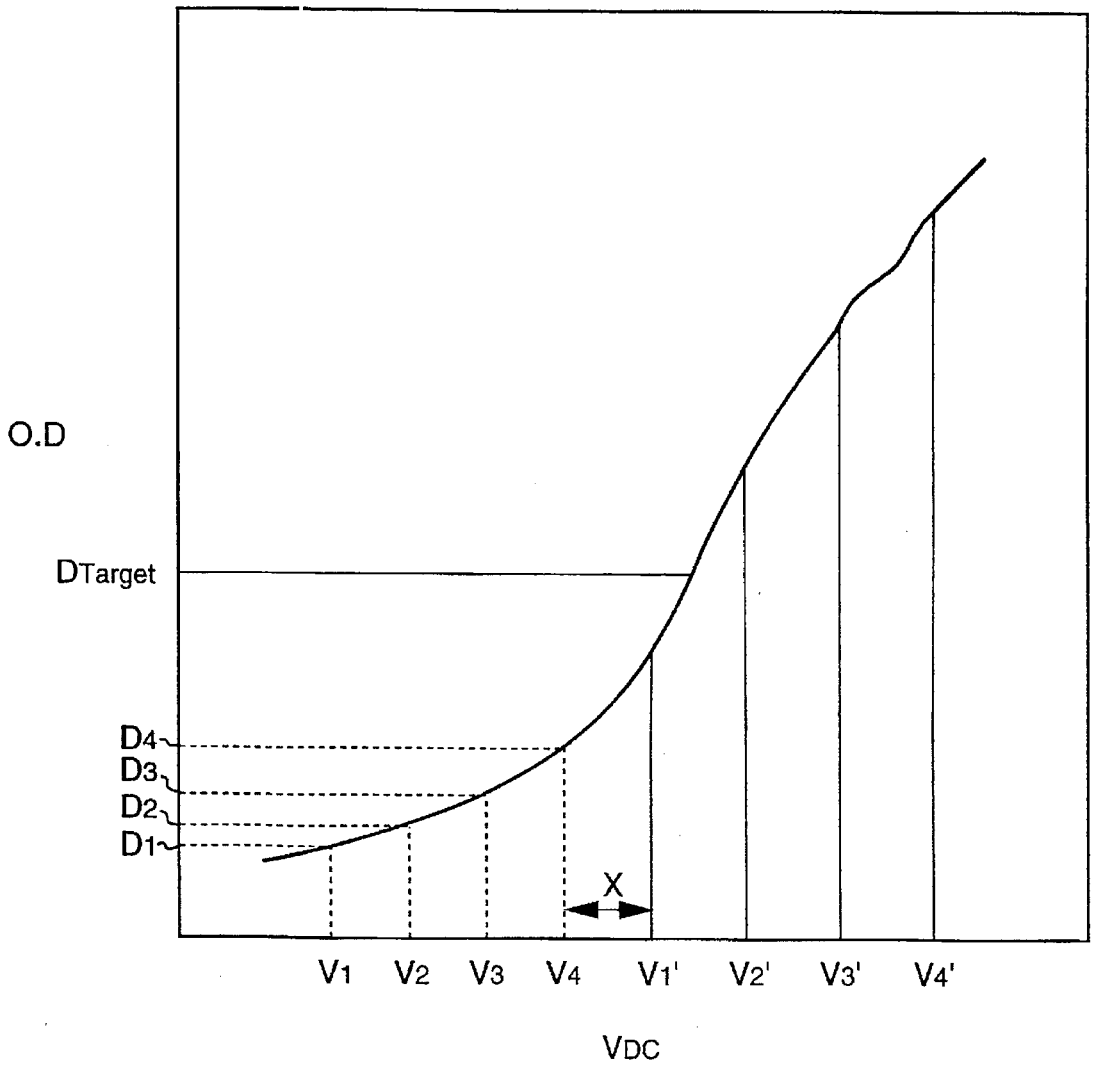
FIG. 8 is a chart showing a developing bias utilized in an image density control according to the third embodiment.

Meanwhile, when D4<DTarget and LT4/L34≧k, the characteristic is assumed to be as shown in FIG. 8. Accordingly, the developing biases V1 to V4 for forming patches are changed to V1' to V4' as shown in FIG. 8. Note that an interval x, between V1 and V4' in FIG. 7, or the between V4 and V1' in FIG. 8, should be preferably more than the aforementioned interval, w, between V1 and V2. In this case, an interval between V1' and V2' may be w.

As explained above, according to the present embodiment, in the case where the V-D characteristic is largely changed at the time of the Dmax control, the developing bias is altered, then the Dmax control is performed again to obtain VTarget. Accordingly, a stable image can be obtained at all times. Further, in a case where a control error still occurs as a result of the Dmax control, it is determined that the V-D characteristic is so largely changed that it cannot be corrected by the Dmax control. Then, a default value is utilized as a developing bias for an image forming. Accordingly, it is possible to prevent further deterioration of image quality.

As has been discussed above, according to the present embodiment, in a case where a target density is out of a range of patch density values which are detected, a process condition for performing a predetermined image density control is determined based upon an extrapolation executed with a process condition corresponding to two density values which are closest to a target density. As a result, an image having a stable density can be obtained at all times with minimum toner consumption.

Note that the image forming apparatus according to the present invention is not limited to the above embodiments and various changes and modifications can be made within the spirit and scope of the present invention. For instance, as an interpolation method, an interpolation using a polynomial or the like may be utilized besides a linear interpolation. Further, a control subject with respect to the Dmax control may be an electrification potential or an exposure amount besides a developing bias. Needless to say, the present invention is applicable to a multicolor image forming apparatus.

In addition, in a multicolor image forming apparatus employing a multiple transfer process using a transfer body, a patch may be formed on the transfer body to perform the Dmax control.

The present invention can be applied to a system constituted by a plurality of devices, or to an apparatus comprising a single device. Furthermore, the invention is applicable also to a case where the object of the invention is attained by supplying a program to a system or apparatus.

To appraise the public of the scope of the prevent invention, the following claims are made.

What is claimed is:

1. An image forming apparatus comprising:

forming means for forming a plurality of images for measurement on a recording medium in different processing conditions;

measurement means for measuring densities of the plurality of images formed on said recording medium;

judging means for judging whether or not a target density value is somewhere between a maximum value and a minimum value of the density measured by said measurement means; and control means for determining a processing condition for obtaining said target density value in accordance with two measured density values that are closest to said target density value and are inclusive of said target density value therebetween, if said target density value is somewhere between said maximum and minimum values of the density, and for determining a processing condition for obtaining said target density value in accordance with two measured density values that are closest to said target density value, if said target density value is outside the range from said maximum value to said minimum value of the density.

2. The apparatus according to claim 1, further comprising a memory for storing a processing condition determined by said control means for later image forming.

3. The apparatus according to claim 1, further comprising:

detection means for detecting an environmental condition, wherein said control means selects a processing condition when said forming means forms an image for measurement, in accordance with the environmental condition detected by said detection means.

4. The apparatus according to claim 1, wherein said forming means forms said images by forming a latent image on said recording medium by developing the formed latent image with developer, and wherein said processing condition includes a developing bias.

5. The apparatus according to claim 1, wherein said target density value is a maximum density for later image forming.

6. An image forming apparatus comprising:

forming means for forming a plurality of images for measurement on a recording medium in different processing conditions;

measurement means for measuring densities of the plurality of images formed on said recording medium; and control means for determining a processing condition for obtaining a target density value in accordance with two measured density values that are closest to the target density value among a plurality of densities measured by said measurement means, wherein if a ratio of a difference between one of two processing conditions at the time of forming two images for measurement which are related to said two measured density values and the determined processing condition, to a difference between said two processing conditions is more than a predetermined value, said control means determines a processing condition so as to obtain said target density value by causing said forming means to form a plurality of images for measurement and said measurement means to perform density measuring again with altered processing conditions.

7. The apparatus according to claim 6, wherein said control means employs the determined processing condition if said ratio is less than the predetermined value.

8. The apparatus according to claim 6, wherein said control means judges whether or not said ratio is more than the predetermined value when said target density value is outside the range from a maximum value to a minimum value of the measured densities.

9. The apparatus according to claim 6, further comprising a memory for storing a processing condition determined by said control means for later image forming.

10. The apparatus according to claim 6, further comprising:

detection means for detecting an environmental condition, wherein said control means selects a processing condition when said forming means forms an image for measurement, in accordance with the environmental condition detected by said detection means.

11. The apparatus according to claim 6, wherein said forming means forms said images by forming a latent image on said recording medium by developing the formed latent image with developer, and wherein said processing condition includes a developing bias.

12. The apparatus according to claim 6, wherein said target density value is a maximum density for later image forming.

13. An image forming apparatus comprising:

forming means for forming a plurality of images for measurement on a recording medium in different processing conditions;

measurement means for measuring densities of the plurality of images formed on said recording medium; and control means for determining a processing condition for obtaining a target density value in accordance with two measured density values that are closest to the target density value among a plurality of densities measured by said measurement means, wherein if a ratio of a difference between one of two processing conditions at the time of forming two images for measurement which are related to said two measured density values and the determined processing condition, to a difference between said two processing conditions is more than a predetermined value, said control means employs a processing condition with a predetermined value instead of the determined processing condition.

14. The apparatus according to claim 13, further comprising a memory for storing the employed processing condition for later image forming.

15. The apparatus according to claim 13, further comprising:

detection means for detecting an environmental condition, wherein said control means selects a processing condition when said forming means forms an image for measurement, in accordance with the environmental condition detected by said detection means.

16. The apparatus according to claim 13, wherein said forming means forms said images by forming a latent image on said recording medium by developing the formed latent image with developer, and wherein said processing condition includes a developing bias.

17. The apparatus according to claim 13, wherein said target density value is a maximum density for later image forming.

18. The apparatus according to claim 13, wherein said control means judges whether or not said ratio is more than the predetermined value when said target density value is outside the range from a maximum value to a minimum value of the measured densities.

19. An image forming method in an image forming apparatus, comprising the steps of:

forming a plurality of images for measurement on a recording medium in different processing conditions;

measuring densities of the plurality of images;

judging whether or not a target density value is somewhere between a maximum value and a minimum value of the measured density;

determining a processing condition for obtaining said target density value in accordance with two measured density values that are closest to said target density value and are inclusive of said target density value therebetween, if said target density value is somewhere between said maximum and minimum values of the density; and determining a processing condition for obtaining said target density value in accordance with two measured density values that are closest to said target density value, if said target density value is outside the range from said maximum value to said minimum value of the density.

20. The method according to claim 19, further comprising the step of storing the determined processing condition in a memory for later image forming.

21. The method according to claim 19, wherein in said forming step, a plurality of processing conditions are set in accordance with an environmental condition in order to form a plurality of images for measurement.

22. A density control method in an image forming apparatus, comprising the steps of:

forming a plurality of images for measurement on a recording medium in different processing conditions;

measuring densities of the plurality of images for measurement;

determining a processing condition for obtaining a target density value in accordance with two measured density values that are closest to the target density value among a plurality of measured densities;

judging whether or not a ratio of a difference between one of two processing conditions at the time of forming two images for measurement which are related to said two measured density values and the determined processing condition determined in said determining step, to a difference between said two processing conditions is more than a predetermined value; and repeating the forming step, measuring step, and determining step again with altered processing conditions if the ratio is more than the predetermined value.

23. The method according to claim 22 further comprising the step of storing the determined processing condition in a memory for later image forming if said ratio is less than the predetermined value.

24. The method according to claim 22, further comprising the step of judging whether or not said target density value is outside the range from a maximum value to a minimum value of the densities measured at said measuring step, wherein when said target density value is outside the range from the maximum to minimum values of the measured densities, said judging of the ratio is not executed.

25. The method according to claim 22, wherein in said forming step, a plurality of processing conditions are set in accordance with an environmental condition in order to form a plurality of images for measurement.

26. A density control method in an image forming apparatus comprising the steps of:

forming a plurality of images for measurement on a recording medium in different processing conditions;

measuring densities of the plurality of images for measurement;

determining a processing condition for obtaining a target density value in accordance with two measured density values that are closest to the target density value among a plurality of measured densities;

judging whether or not a ratio of a difference between one of two processing conditions at the time of forming two images for measurement which are related to said two measured density values and the determined processing condition determined in said determining step, to a difference between said two processing conditions is more than a predetermined value; and employing a processing condition with a predetermined value instead of the determined processing condition if the ratio is more than the predetermined value.

27. The method according to claim 26 further comprising the step of storing the employed processing condition in a memory for later image forming.

28. The method according to claim 26 further comprising the step of storing the determined processing condition in a memory for later image forming if said ratio is less than the predetermined value.

29. The method according to claim 26, wherein in said forming step, a plurality of processing conditions are set in accordance with an environmental condition in order to form a plurality of images for measurement.

* * * * *

UNITED STATES PATENT AND TRADEMARK OFFICE

CERTIFICATE OF CORRECTION

PATENT NO. : 5,666,588

DATED : Sept. 9, 1997

INVENTOR(S) : UCHIYAMA ET AL.

It is certified that error appears in the above-identified patent and that said Letters Patent is hereby corrected as shown below:

Column 5

Line 53, "resulting" should read --resulting in--.

Column 6

Line 45, "the" should be deleted.

Column 10

Line 13, "claim 22" should read --claim 22,--;
Line 50, "claim 26" should read --claim 26, --; and
Line 53, "claim 26" should read --claim 26, --.

Signed and Sealed this

Twenty-fourth Day of March, 1998

Bruce Lehman

*Attest:*

BRUCE LEHMAN

*Attesting Officer*

*Commissioner of Patents and Trademarks*